US010115368B2

(12) United States Patent
Zeng

(10) Patent No.: US 10,115,368 B2
(45) Date of Patent: Oct. 30, 2018

(54) LIQUID CRYSTAL DISPLAY DRIVING METHOD AND DRIVE DEVICE

(71) Applicant: Shenzhen China Star Optoelectronics Technology Co., Ltd., Shenzhen (CN)

(72) Inventor: Dekang Zeng, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 148 days.

(21) Appl. No.: 15/303,036

(22) PCT Filed: Jun. 30, 2016

(86) PCT No.: PCT/CN2016/087801
§ 371 (c)(1),
(2) Date: Oct. 10, 2016

(87) PCT Pub. No.: WO2017/201811
PCT Pub. Date: Nov. 30, 2017

(65) Prior Publication Data

US 2018/0005596 A1 Jan. 4, 2018

(30) Foreign Application Priority Data

May 27, 2016 (CN) ..... 2016 1 0367103

(51) Int. Cl.
*G09G 3/36* (2006.01)

(52) U.S. Cl.
CPC ..... *G09G 3/3696* (2013.01); *G09G 3/3607* (2013.01); *G09G 3/3611* (2013.01); *G09G 3/3688* (2013.01); *G09G 2310/027* (2013.01); *G09G 2310/0289* (2013.01); *G09G 2320/0252* (2013.01); *G09G 2340/16* (2013.01); *G09G 2360/16* (2013.01)

(58) Field of Classification Search
CPC ..... G09G 3/3696; G09G 3/3607; G09G 2310/0289; G09G 2310/027
See application file for complete search history.

(56) References Cited

U.S. PATENT DOCUMENTS

| | | | | |
|---|---|---|---|---|
| 7,804,474 | B2 | 9/2010 | Chen et al. | |
| 2005/0146495 | A1 | 7/2005 | MacKinnon et al. | |
| 2008/0002912 | A1* | 1/2008 | Chen | G09G 3/3648 382/298 |
| 2010/0091033 | A1 | 4/2010 | Itoyama et al. | |

(Continued)

FOREIGN PATENT DOCUMENTS

| | | |
|---|---|---|
| CN | 101097698 | 1/2008 |
| CN | 101197119 | 6/2008 |

(Continued)

*Primary Examiner* — Andrew Sasinowski

(57) ABSTRACT

A liquid crystal display driving method provided includes the following steps: acquiring a current gray level value of a current frame image; determining a gray level of the current gray level value; if the current gray level value is the high gray level, then determining whether to perform an overvoltage driving according to a first gray level difference threshold value; if the current gray level value is the low gray level, then determining whether to perform the overvoltage driving according to a second gray level difference threshold value. The present invention can precisely determine whether to perform the overvoltage driving on the pixel electrode.

14 Claims, 6 Drawing Sheets

(56) References Cited

U.S. PATENT DOCUMENTS

| | | | | |
|---|---|---|---|---|
| 2013/0113842 | A1* | 5/2013 | Hwang | G09G 3/2022 345/690 |
| 2015/0035878 | A1* | 2/2015 | Zhu | G09G 3/3648 345/694 |

FOREIGN PATENT DOCUMENTS

| | | |
|---|---|---|
| CN | 101647056 | 2/2010 |
| CN | 103310742 | 9/2013 |

* cited by examiner

LIQUID CRYSTAL DISPLAY DRIVING METHOD AND DRIVE DEVICE

RELATED APPLICATIONS

This application is a National Phase of PCT Patent Application No. PCT/CN2016/087801 having International filing date of Jun. 30, 2016, which claims the benefit of priority of Chinese Patent Application No. 201610367103.0 filed on May 27, 2016. The contents of the above applications are all incorporated by reference as if fully set forth herein in their entirety.

FIELD AND BACKGROUND OF THE INVENTION

The present invention relates to the technical field of driving circuits, and particularly to a liquid crystal display driving method and drive device.

An existing liquid crystal display usually uses an overvoltage driving (Over Driver, OD) technology to solve a blurring problem. Each steady state of a liquid crystal molecule corresponds to a predetermined voltage. When a voltage is applied to an electrode, the liquid crystal molecule does not rotate to a target state, but achieves the state after a predetermined response time. When the voltage is higher, the molecule rotates faster. In a traditional liquid crystal display, a driving voltage applied to the liquid crystal molecule is a corresponding voltage of the target state, because different gray levels have different corresponding voltages, the molecule needs to rotate over different angles, resulting in different response times for the molecule to shift between the different gray levels. In the liquid crystal display using the overvoltage driving technology, the applied driving voltage is a little higher than the corresponding voltage of the target state in the beginning, making the liquid crystal molecule rotate faster, and when the target state is achieved, the voltage falls back to the corresponding voltage of the target state to maintain the state, thus the response time is efficiently shortened, and the response times for the molecule to shift between different gray levels can be more even.

The aforementioned overvoltage driving technology increases the reaction speed of the liquid crystal molecule through applying an electrical field larger than the one corresponding to the original steady state, to make the liquid crystal molecule rotate to a predetermined angle in less time, which can reduce the response time of the liquid crystal molecule to 8 ms or less. For example: shifting the liquid crystal molecule from an initial gray level (such as level 0) to a target gray level (such as level 128), setting the level 0 driving voltage to be 0V, the level 128 driving voltage to be 3V, when an image of the liquid crystal display transfers from level 0 to level 128, if the driving voltage is set to transfer from 0V to 3V, the liquid crystal molecule usually does not rotate fast enough. The driving voltage is usually set to transfer from 0V to 4V to increase the speed (assuming that 4V is a driving voltage of level 150), then an overvoltage driving lookup table (LUT) is needed. Thus when the voltage transfers from level 0 to level 128, an overvoltage driving gray level value of level 150 can be obtained through the lookup table, then the level 150 takes the place of the original level 128 for performing the overvoltage driving operation.

To increase the response speed of the liquid crystal panel, the overvoltage driving technology is widely used. The principle is determining whether each pixel electrode needs to perform the overvoltage driving through comparing the image change of the current and the previous frames, according to a gray level difference value of the current and the previous frame images of each pixel electrode. Practically, determining the set of the gray level difference threshold value needed by activating the overvoltage driving is very important. If the gray level difference threshold value to activate the overvoltage driving is set to be too small, an irregular image would result from a fluctuation of the front-end data login resulting in the wrong activation of the overvoltage driving. If the gray level difference threshold value of activating the overvoltage driving is set to be too large, it would result in part of the pixel electrode which should perform the overvoltage driving not performing the overvoltage driving, thereby affecting the response time. The existing design acquires a balance point between the gray level difference threshold values, which can be too large or too small, according to the actual image performance of the pixel electrode. Such a balance point is very difficult to precisely determine when it needs to perform the overvoltage driving to the pixel electrode. This problem of the existing technology badly needs to be improved.

SUMMARY OF THE INVENTION

The present invention aims to provide a liquid crystal display driving method and drive device, to overcome the difficulty of precisely determining whether to perform the overvoltage driving, and the problem of the setting of the gray level difference threshold value activating the overvoltage driving on the pixel electrode being too large or too small, in the existing technology, when it comes to determining whether to perform the overvoltage driving according to the gray level difference value of the previous and the current frame images of each pixel electrode, the setting of the gray level difference threshold value activating the overvoltage driving to the pixel electrode being too large or too small.

The technical scheme of the present invention is the following: a liquid crystal display driving method, including the following steps: acquiring a gray level value of a current frame image of a pixel electrode of a liquid crystal display when the liquid crystal display is activated; determining a gray level of the current gray level value, the gray level including a high gray level and a low gray level; if the current gray level value is the high gray level, then determining whether to perform an overvoltage driving on the pixel electrode according to a first gray level difference threshold value which is predetermined; if the current gray level value is the low gray level, then determining whether to perform the overvoltage driving on the pixel electrode according to a second gray level difference threshold value which is predetermined, and the first gray level difference threshold value being less than the second gray level difference threshold value. Determining whether to perform the overvoltage driving on the pixel electrode according to the first gray level difference threshold value which is predetermined specifically includes: acquiring a first gray level difference value of the current frame image and a previous frame image; determining whether the first gray level difference value is larger than the first gray level difference threshold value; if the first gray level difference value is larger than the first gray level difference threshold value, then activating the overvoltage driving. Determining whether to perform the overvoltage driving on the pixel electrode according to the second gray level difference threshold value which is predetermined specifically includes: acquiring a second gray level difference value of the current frame image and the previous frame image; determining whether the second gray level difference value is larger than the second gray level difference threshold value; if the second gray level difference value is larger than the second gray level difference threshold value, then activating the overvoltage driving.

Preferably, the first gray level difference value and the second gray level difference value each are an absolute value of a difference value between the current gray level value and the gray level value of the previous frame image.

Preferably, a gray level range of the high gray level are integers from 128 to 255, a gray level range of the low gray level are integers from 0 to 127.

Preferably, the second gray level difference threshold value is any integer among 4 to 6, the first gray level difference threshold value is any integer among 0 to 3.

A liquid crystal display driving method includes the following steps: acquiring a current gray level value of a current frame image of a pixel electrode frame image of a liquid crystal display when the liquid crystal display is activated; determining a gray level of the current gray level value, the gray level including a high gray level and a low gray level; if the current gray level value is the high gray level, then determining whether to perform an overvoltage driving on the pixel electrode according to a first gray level difference threshold value which is predetermined; if the current gray level value is the low gray level, then determining whether to perform the overvoltage driving on the pixel electrode according to a second gray level difference threshold value which is predetermined, and the first gray level difference threshold value being less than the second gray level difference threshold value.

Preferably, determining whether to perform the overvoltage driving on the pixel electrode according to the first gray level difference threshold value which is predetermined specifically includes: acquiring a first gray level difference value of the current frame image and a previous frame image; determining whether the first gray level difference value is larger than the first gray level difference threshold value; if the first gray level difference value is larger than the first gray level difference threshold value, then activating the overvoltage driving.

Preferably, determining whether to perform the overvoltage driving to the pixel electrode according to the second gray level difference threshold value which is predetermined specifically includes: acquiring a second gray level difference value of the current frame image and the previous frame image; determining whether the second gray level difference value is larger than the second gray level difference threshold value; if the second gray level difference value is larger than the second gray level difference threshold value, then activating the overvoltage driving.

Preferably, the first gray level difference value and the second gray level difference value each are an absolute value of a difference value between the current gray level value and the gray level value of the previous frame image.

Preferably, a gray level range of the high gray level are integers from 128 to 255, a gray level range of the low gray level are integers from 0 to 127.

Preferably, the second gray level difference threshold value is any integer among 4 to 6, the first gray level difference threshold value is any integer among 0 to 3.

A liquid crystal display driving device includes: a gray level value acquiring module acquiring a gray level value of a current frame image of a pixel electrode of a liquid crystal display when the liquid crystal display is activated; a gray level determining module determining a gray level of the current gray level value, the gray level including a high gray level and a low gray level; a first driving module determining whether to perform an overvoltage driving on the pixel electrode according to a first gray level difference threshold value which is predetermined if the current gray level value is the high gray level; a second driving module determining whether to perform the overvoltage driving on the pixel electrode according to a second gray level difference threshold value which is predetermined if the current gray level value is the low gray level, and the first gray level difference threshold value being less than the second gray level difference threshold value.

Preferably, the first driving module includes: a first acquiring unit acquiring a first gray level difference value of the current frame image and a previous frame image; a first determining unit determining whether the first gray level difference value is larger than the first gray level difference threshold value; a first activating unit activating the overvoltage driving if the first gray level difference value is larger than the first gray level difference threshold value.

Preferably, the second driving module includes: a second acquiring unit acquiring a second gray level difference value of the current frame image and the previous frame image; a second determining unit determining whether the second gray level difference value is larger than the second gray level difference threshold value; a second activating unit activating the overvoltage driving if the second gray level difference value is larger than the second gray level difference threshold value.

Preferably, the first gray level difference value and the second gray level difference value each are an absolute value of a difference value between the current gray level value and the gray level value of the previous frame image.

Preferably, a gray level range of the high gray level is integers from 128 to 255.

Preferably, a gray level range of the low gray level is integers from 0 to 127.

Preferably, the second gray level difference threshold value is any integer among 4 to 6.

Preferably, the first gray level difference threshold value is any integer among 0 to 3.

A liquid crystal display driving method and drive device of the present invention acquires a current frame image and a previous frame image through determining whether the first gray level difference value or the second gray level difference value of the gray level value of the current frame image of the current frame image of the pixel electrode is high gray level or low gray level, then determines whether pixel electrode performs the overvoltage driving on the pixel electrode according to the predetermined first gray level difference threshold value or second gray level difference threshold value, thus precisely determines whether it is necessary to perform the overvoltage driving to the pixel electrode, without the irregular image resulting from the overvoltage driving being activated incorrectly, and the response time of the pixel electrode being affected.

BRIEF DESCRIPTION OF THE SEVERAL VIEWS OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF SPECIFIC EMBODIMENTS OF THE INVENTION

To achieve the above-mentioned objects and effects, the techniques, measures, and structure of the present invention are illustrated in the figures and descriptions of preferred embodiments below.

Figure 1:
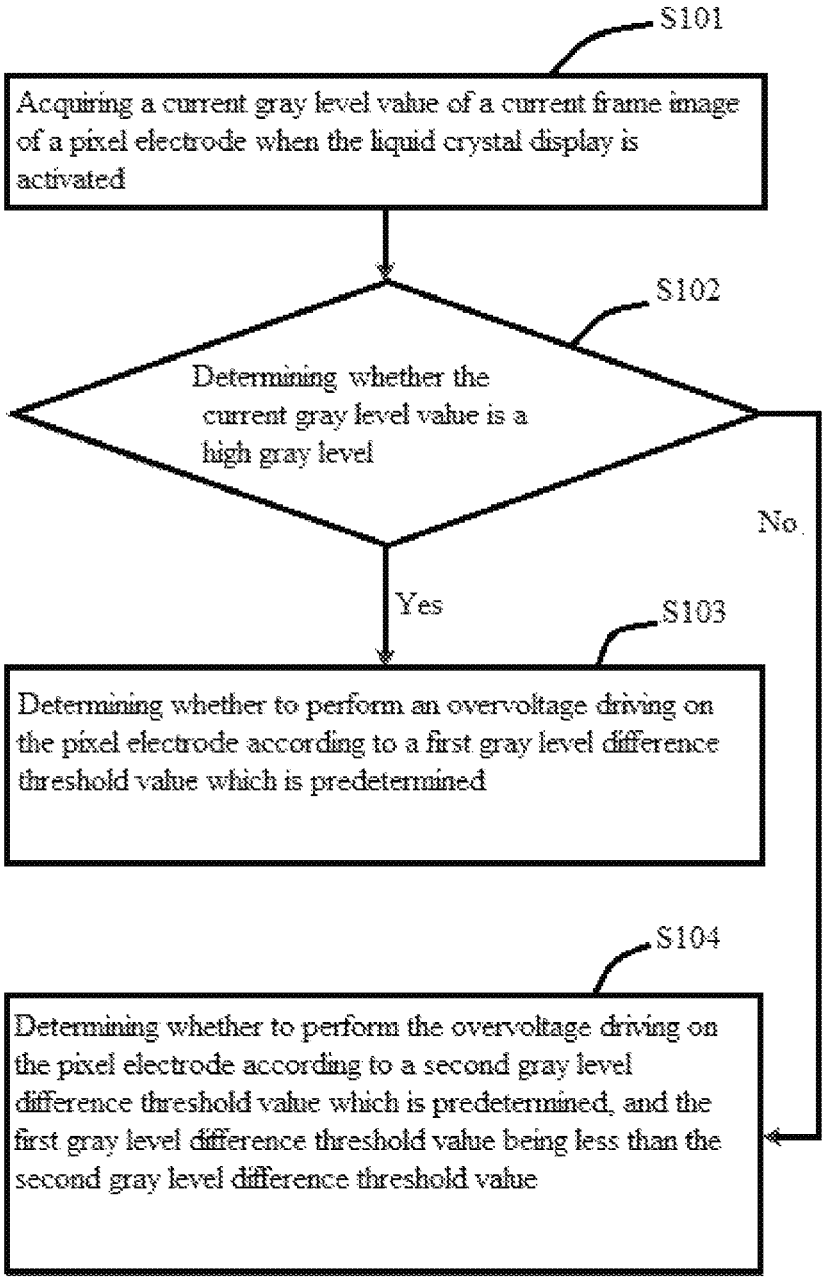
FIG. 1 illustrates a flowchart of a liquid crystal display driving method according to an embodiment of the present invention.

Please refer to FIG. 1, which illustrates a flowchart of a liquid crystal display driving method according to an embodiment of the present invention. It can be seen from FIG. 1, a liquid crystal display driving method of the present invention includes the following steps:

Step S101: acquiring a gray level value of a current frame image of a pixel electrode of a liquid crystal display when the liquid crystal display is activated.

Step S102: determining a gray level of the current gray level value, the gray level including a high gray level and a low gray level.

Step S103: if the current gray level value is the high gray level, then determining whether to perform an overvoltage driving on the pixel electrode according to a first gray level difference threshold value which is predetermined.

Step S104: if the current gray level value is the low gray level, then determining whether to perform the overvoltage driving on the pixel electrode according to a second gray level difference threshold value which is predetermined, and the first gray level difference threshold value being less than the second gray level difference threshold value.

Figure 2:
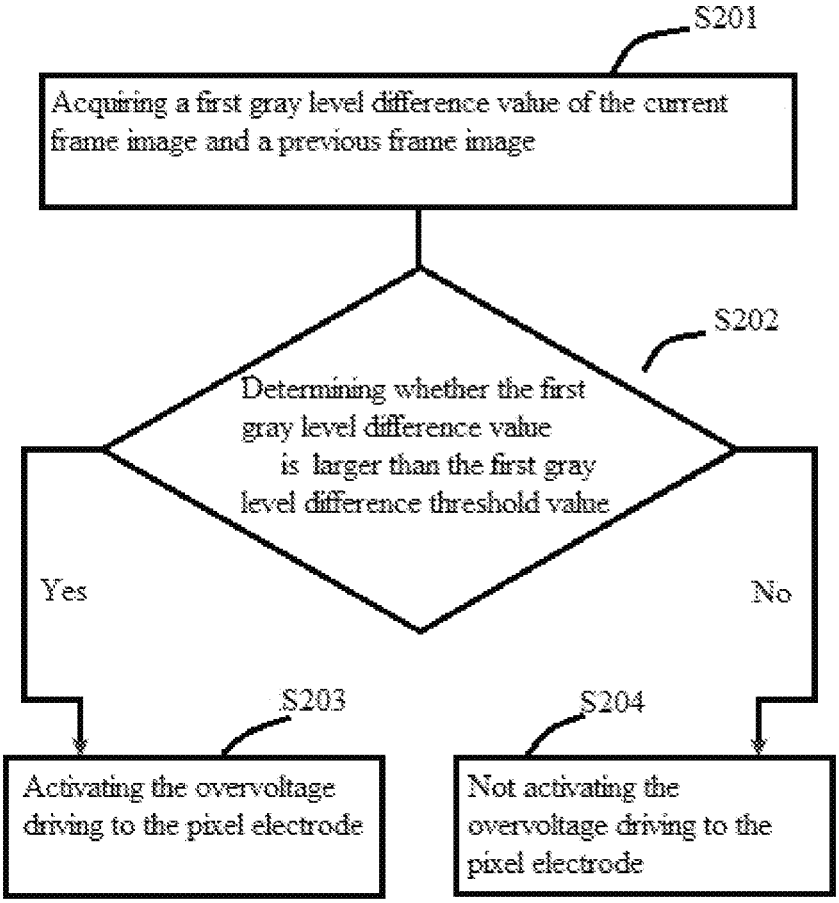
FIG. 2 illustrates a flowchart of determining whether to perform the overvoltage driving to the pixel electrode according to a first gray level difference threshold value which is predetermined according to the embodiment of the present invention.

Please refer to FIG. 2, which illustrates a flowchart of determining whether to perform the overvoltage driving to the pixel electrode according to a first gray level difference threshold value which is predetermined according to the embodiment of the present invention. It can be seen from FIG. 2 that if the current gray level value is a high gray level, then determining whether to perform the overvoltage driving on the pixel electrode according to the first gray level difference threshold value which is predetermined specifically includes:

Step S201: acquiring a first gray level difference value of the current frame image and a previous frame image.

Step S202: determining whether the first gray level difference value is larger than the first gray level difference threshold value.

Step S203: if the first gray level difference value is larger than the first gray level difference threshold value, then activating the overvoltage driving.

Figure 3:
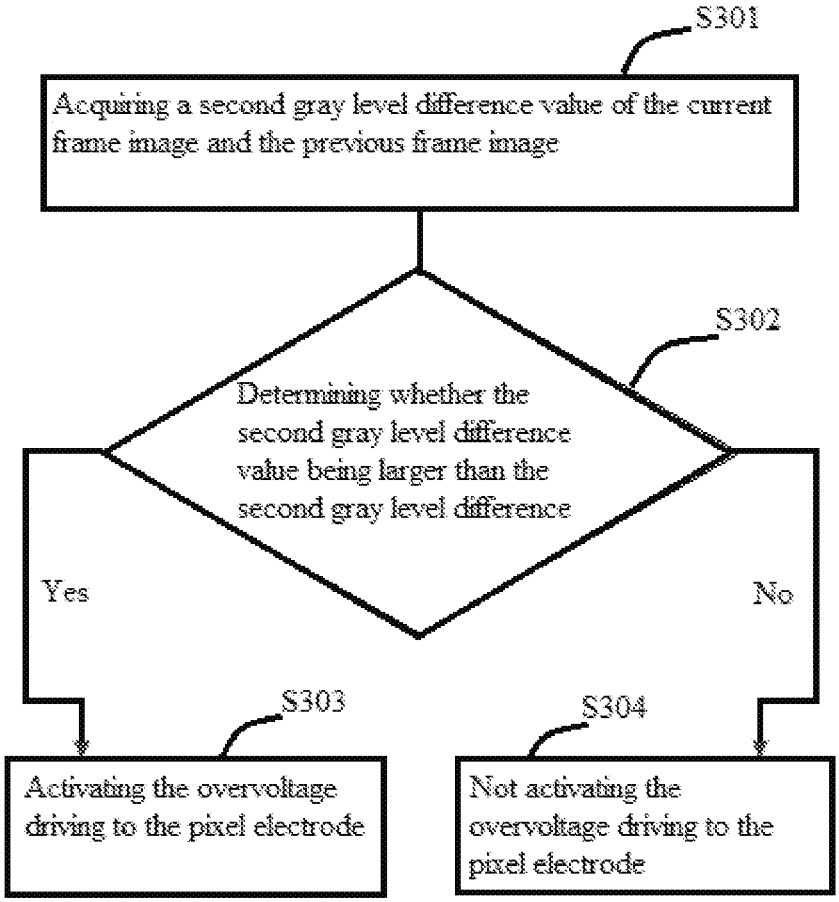
FIG. 3 illustrates a flowchart of determining whether to perform the overvoltage driving to the pixel electrode according to a second gray level difference threshold value which is predetermined according to the embodiment of the present invention.

Please refer to FIG. 3, which illustrates a flowchart of determining whether to perform the overvoltage driving on the pixel electrode according to a second gray level difference threshold value which is predetermined according to the embodiment of the present invention. It can be seen from FIG. 3, if the current gray level value is a low gray level, then determining whether to perform the overvoltage driving on the pixel electrode according to the second gray level difference threshold value which is predetermined specifically includes:

Step S301: acquiring a second gray level difference value of the current frame image and the previous frame image.

Step S302: determining whether the second gray level difference value is larger than the second gray level difference threshold value.

Step S303: if the second gray level difference value is larger than the second gray level difference threshold value, then activating the overvoltage driving.

In the present embodiment, the first gray level difference value and the second gray level difference value each are an absolute value of a difference value between the current gray level value and the gray level value of the previous frame image.

In the present embodiment, a gray level range of the high gray level are integers from 128 to 255, a gray level range of the low gray level are integers from 0 to 127.

In the present embodiment, the second gray level difference threshold value is any integer among 4 to 6, the first gray level difference threshold value is any integer among 0 to 3.

In the present embodiment, the first gray level difference threshold value is set to be less than the second gray level difference threshold value, due to human eye being more sensitive to a static performance of the low gray level, so the gray level difference threshold value for the low gray level is set to be larger, in order to prevent a fluctuation of the front-end data login from causing the overvoltage driving being incorrectly activated, resulting in an irregular display. The gray level difference threshold value for the high gray level can be set to be smaller, in order to increase the response speed of the entire system.

A liquid crystal display driving method of the present invention determines whether the gray level value of the current frame image of the pixel electrode is the high gray level or the low gray level, then acquires the first gray level difference value or the second gray level difference value of the current frame image and the previous frame image, then determines whether to perform the overvoltage driving on the pixel electrode according to the predetermined first gray level difference threshold value or second gray level difference threshold value, and precisely determines whether to perform the overvoltage driving on the pixel electrode, without the irregular image resulting from the overvoltage driving being activated incorrectly, and the response time of the pixel electrode being adversely affected.

Figure 4:
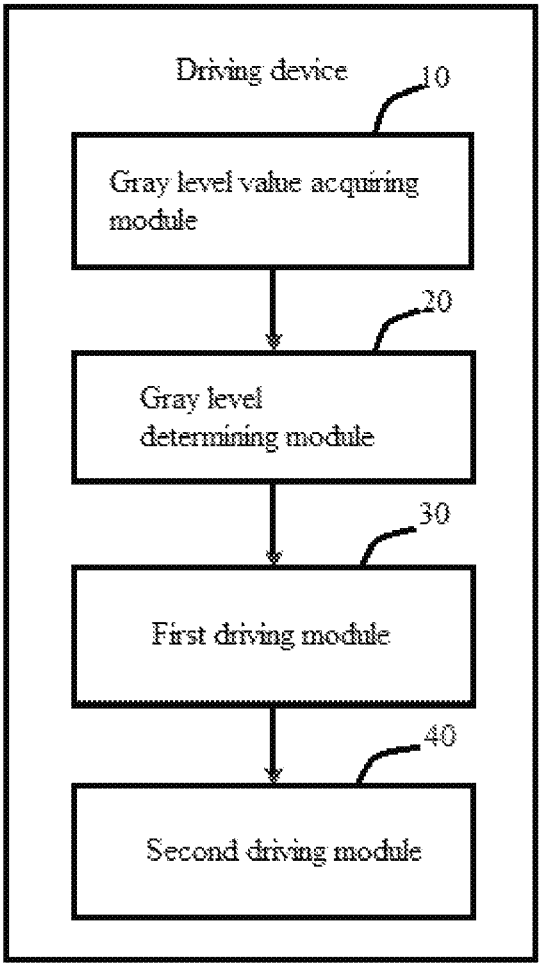
FIG. 4 illustrates a block diagram of a structure of a liquid crystal display driving device according to the embodiment of the present invention.

Please refer to FIG. 4, which illustrates a block diagram of a structure of a liquid crystal display driving device according to the embodiment of the present invention. It can be seen from FIG. 4 that a liquid crystal display driving device of the present invention includes: a gray level value acquiring module 10, acquiring a gray level value of a current frame image of a pixel electrode when driving the liquid crystal display; a gray level determining module 20 determining a gray level of the current gray level value, the gray level including a high gray level and a low gray level; a first driving module 30 determining whether to perform an overvoltage driving on the pixel electrode according to a first gray level difference threshold value which is predetermined if the current gray level value is the high gray level; a second driving module 40 determining whether to perform the overvoltage driving on the pixel electrode according to a second gray level difference threshold value which is predetermined if the current gray level value is the low gray level, and the first gray level difference threshold value being less than the second gray level difference threshold value.

Figure 5:
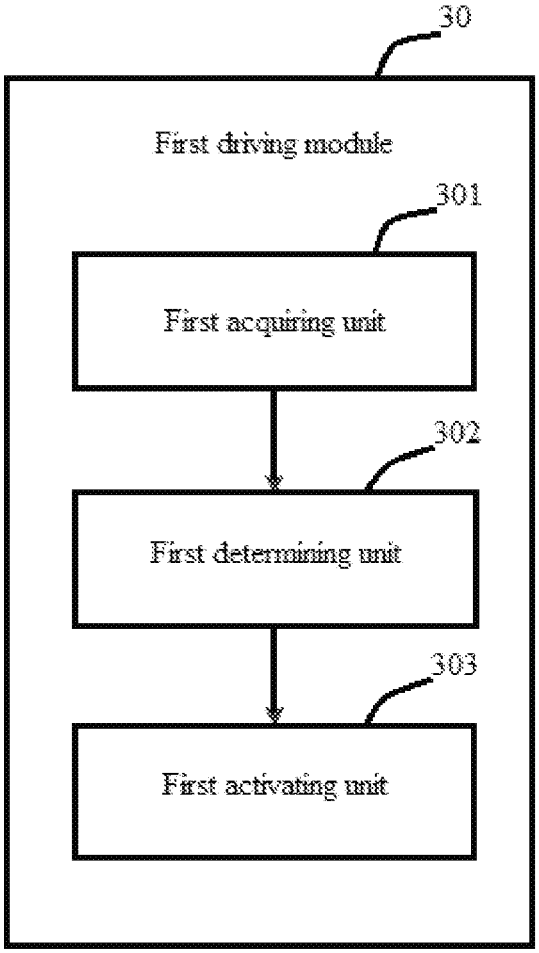
FIG. 5 illustrates a block diagram of a structure of a first driving module according to the embodiment of the present invention.

FIG. 5 illustrates a block diagram of a structure of the first driving module 30 according to the embodiment of the present invention. It can be seen from FIG. 5 that in the present embodiment the first driving module 30 includes: a first acquiring unit 301 acquiring a first gray level difference value of the current frame image and a previous frame image; a first determining unit 302, determining whether the first gray level difference value being larger than the first gray level difference threshold value; and a first activating unit 303 activating the overvoltage driving if the first gray level difference value is larger than the first gray level difference threshold value.

Figure 6:
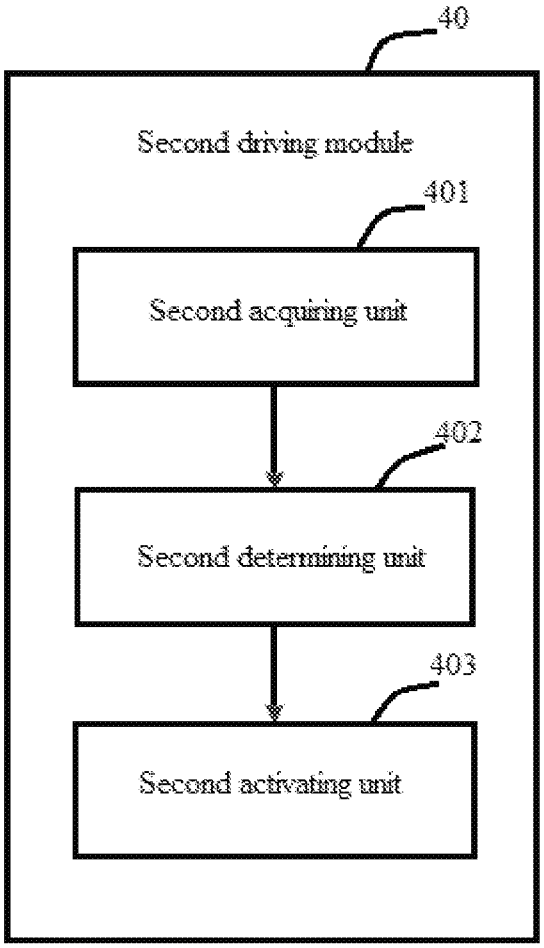
FIG. 6 illustrates a block diagram of a structure of a second driving module according to the embodiment of the present invention.

FIG. 6 illustrates a block diagram of a structure of a second driving module 40 according to the embodiment of the present invention. It can be seen from FIG. 6 that in the present embodiment the second driving module 40 includes: a second acquiring unit 401 acquiring a second gray level difference value of the current frame image and the previous frame image; a second determining unit 402 determining whether the second gray level difference value is larger than the second gray level difference threshold value; and a second activating unit 403, activating the overvoltage driving if the second gray level difference value is larger than the second gray level difference threshold value.

In the present embodiment, the first gray level difference value and the second gray level difference value each are an absolute value of a difference value between the current gray level value and the gray level value of the previous frame image.

A liquid crystal display drive device of the present invention acquires a current frame image and a previous frame image through determining whether the first gray level difference value or the second gray level difference value of the gray level value of the current frame image of the current frame image of the pixel electrode is high gray level or low gray level, then determines whether pixel electrode performs the overvoltage driving on the pixel electrode according to the predetermined first gray level difference threshold value or second gray level difference threshold value, and thus precisely determines whether it is necessary to perform the overvoltage driving on the pixel electrode without the irregular image resulting from the overvoltage driving being activated incorrectly, and the response time of the pixel electrode being adversely affected.

The foregoing preferred embodiments of the present invention are illustrative of the present invention rather than limiting of the present invention. It is intended to cover various modifications and changes included within the spirit and scope of the appended claims, the scope of which should be accorded the broadest interpretation so as to encompass all such modifications and similar structures.

What is claimed is:

1. A liquid crystal display driving method, comprising the following steps:

acquiring a gray level value of a current frame image of a pixel electrode of a liquid crystal display when the liquid crystal display is activated;

determining a gray level of the current gray level value, the gray level including a high gray level and a low gray level;

if the current gray level value is the high gray level, then determining whether to perform an overvoltage driving on the pixel electrode according to a first gray level difference threshold value which is predetermined;

if the current gray level value is the low gray level, then determining whether to perform the overvoltage driving on the pixel electrode according to a second gray level difference threshold value which is predetermined, and the first gray level difference threshold value being less than the second gray level difference threshold value;

wherein determining whether to perform the overvoltage driving on the pixel electrode according to the first gray level difference threshold value which is predetermined comprises:

acquiring a first gray level difference value of the current frame image and a previous frame image;

determining whether the first gray level difference value is larger than the first gray level difference threshold value;

if the first gray level difference value is larger than the first gray level difference threshold value, then activating the overvoltage driving;

wherein determining whether to perform the overvoltage driving on the pixel electrode according to the second gray level difference threshold value which is predetermined comprises:

acquiring a second gray level difference value of the current frame image and the previous frame image;

determining whether the second gray level difference value is larger than the second gray level difference threshold value;

if the second gray level difference value is larger than the second gray level difference threshold value, then activating the overvoltage driving.

2. The liquid crystal display driving method of claim 1, wherein the first gray level difference value and the second gray level difference value each are an absolute value of a difference value between the current gray level value and the gray level value of the previous frame image.

3. The liquid crystal display driving method of claim 1, wherein a gray level range of the high gray level is integers from 128 to 255, a gray level range of the low gray level is integers from 0 to 127.

4. The liquid crystal display driving method of claim 1, wherein the second gray level difference threshold value is any integer among 4 to 6, the first gray level difference threshold value is any integer among 0 to 3.

5. A liquid crystal display driving method, comprising the following steps:

acquiring a current gray level value of a current frame image of a pixel electrode frame image of a liquid crystal display when the liquid crystal display is activated;

determining a gray level of the current gray level value, the gray level including a high gray level and a low gray level;

if the current gray level value is the high gray level, then determining whether to perform an overvoltage driving on the pixel electrode according to a first gray level difference threshold value which is predetermined; and if the current gray level value being the low gray level, then determining whether to perform the overvoltage driving on the pixel electrode according to a second gray level difference threshold value which is predetermined, and the first gray level difference threshold value being less than the second gray level difference threshold value;

wherein determining whether to perform the overvoltage driving on the pixel electrode according to the first gray level difference threshold value which is predetermined comprises:

acquiring a first gray level difference value of the current frame image and a previous frame image;

determining whether the first gray level difference value is larger than the first gray level difference threshold value; and if the first gray level difference value is larger than the first gray level difference threshold value, then activating the overvoltage driving.

6. The liquid crystal display driving method of claim 5, wherein the first gray level difference value and the second gray level difference value each are an absolute value of a difference value between the current gray level value and the gray level value of the previous frame image.

7. The liquid crystal display driving method of claim 5, wherein a gray level range of the high gray level is integers from 128 to 255, a gray level range of the low gray level is integers from 0 to 127.

8. The liquid crystal display driving method of claim 5, wherein the second gray level difference threshold value is any integer among 4 to 6, the first gray level difference threshold value is any integer among 0 to 3.

9. A liquid crystal display driving device, comprising:

a gray level value acquiring module acquiring a gray level value of a current frame image of a pixel electrode of a liquid crystal display when the liquid crystal display is activated;

a gray level determining module determining a gray level of the current gray level value, the gray level including a high gray level and a low gray level;

a first driving module determining whether to perform an overvoltage driving on the pixel electrode according to a first gray level difference threshold value which is predetermined if the current gray level value is the high gray level;

a second driving module determining whether to perform the overvoltage driving to the pixel electrode according to a second gray level difference threshold value which is predetermined if the current gray level value is the low gray level, and the first gray level difference threshold value being less than the second gray level difference threshold value;

wherein the first driving module comprises:

a first acquiring unit acquiring a first gray level difference value of the current frame image and a previous frame image;

a first determining unit determining whether the first gray level difference value is larger than the first gray level difference threshold value; and a first activating unit activating the overvoltage driving if the first gray level difference value is larger than the first gray level difference threshold value.

10. The liquid crystal display driving device of claim 9, wherein the first gray level difference value and the second gray level difference value each are an absolute value of a difference value between the current gray level value and the gray level value of the previous frame image.

11. The liquid crystal display driving device of claim 9, wherein a gray level range of the high gray level is integers from 128 to 255.

12. The liquid crystal display driving device of claim 9, wherein a gray level range of the low gray level is integers from 0 to 127.

13. The liquid crystal display driving device of claim 9, wherein the second gray level difference threshold value is any integer among 4 to 6.

14. The liquid crystal display driving device of claim 9, wherein the first gray level difference threshold value is any integer among 0 to 3.

* * * * *